US010550653B2

(12) United States Patent
Carnes, Sr.

(10) Patent No.: US 10,550,653 B2
(45) Date of Patent: Feb. 4, 2020

(54) AIR STORAGE SYSTEM

(71) Applicant: William Wesley Carnes, Sr., Lakewood, PA (US)

(72) Inventor: William Wesley Carnes, Sr., Lakewood, PA (US)

( * ) Notice: Subject to any disclaimer, the term of this patent is extended or adjusted under 35 U.S.C. 154(b) by 153 days.

(21) Appl. No.: 15/706,357

(22) Filed: Sep. 15, 2017

(65) Prior Publication Data

US 2018/0128068 A1 May 10, 2018

Related U.S. Application Data

(60) Provisional application No. 62/395,511, filed on Sep. 16, 2016.

(51) Int. Cl.

| | |
|---|---|
| ***E21B 21/10*** | (2006.01) |
| ***E21B 21/16*** | (2006.01) |
| ***E21B 21/08*** | (2006.01) |
| *E21B 19/16* | (2006.01) |
| *E21B 21/00* | (2006.01) |

(52) U.S. Cl.

CPC ..... *E21B 21/10* (2013.01); *E21B 21/08* (2013.01); *E21B 21/16* (2013.01); *E21B 19/16* (2013.01); *E21B 2021/005* (2013.01)

(58) Field of Classification Search

CPC ..... E21B 21/106; E21B 21/16; E21B 21/08

See application file for complete search history.

(56) References Cited

U.S. PATENT DOCUMENTS

| | | | | |
|---|---|---|---|---|
| 2,167,393 | A * | 7/1939 | Muncy | E21B 49/005 175/206 |
| 3,381,523 | A * | 5/1968 | Nettles | E21B 47/1025 166/305.1 |
| 4,407,366 | A * | 10/1983 | Lieffers | E21B 33/00 166/250.01 |
| 10,018,002 | B1 * | 7/2018 | Parker | E21B 21/08 |
| 2006/0124300 | A1 * | 6/2006 | Steiner | E21B 21/067 166/267 |
| 2008/0060846 | A1 * | 3/2008 | Belcher | E21B 17/042 175/25 |

* cited by examiner

*Primary Examiner* — Shane Bomar

(74) *Attorney, Agent, or Firm* — Taylor Russell & Russell, P.C.

(57) ABSTRACT

The present invention relates to air drilling and an apparatus, system and process for air storage for speeding up and making the air drilling process in a wellbore more efficient. The present air storage system is used to divert high pressurized air from the air compressors into an air storage tank for storage during drilling process of adding another piece of pipe to the well. In the present invention, the compressed air can be stored in the air storage system until the connection is made and the driller is ready to resume drilling. This high pressurized, large volume of stored air in the air storage system helps the compressors quickly build up enough air to resume the drilling process thus reducing the amount of drill downtime during the process of making a new pipe connection in a well.

13 Claims, 9 Drawing Sheets

400

| Drilling Step | Air Manifold Valves | | | Automation Valves | | Notes | |
|---|---|---|---|---|---|---|---|
| | 475 Bypass | 480 Dump | 485 Standpipe | 490 Rig | 495 Hi-Pass | | |
| 1 Drilling Ahead | Closed | Closed | Opened | Opened | Closed | Drilling with Rig Air | 405 |
| 2 Making Connection Start Filling Hi-Pass | | | | | | Dump Air Volume | 410 |
| | | | | | | Dump Drillstring | 415 |
| | | | | | | Isolate Drillstring | 420 |
| | | | | | | Start Filling Hi-Pass-"Fill Button" | 425 |
| 3 Hi-Pass Full - By-Pass | Opened | Opened | Closed | | | When $P_H$ gets to 650psi or Set pressure, Hi Pass Closes, Rig Valve opens | 430 |
| 4 Connection Made, Back to bottom | | | | Opened | Closed | Bypassing air, open standpipe. | 435 |
| | | | | | | Close Drillstring dump valve. | 440 |
| | | | | | | Close By-Pass - Air starts filling drillstring. Start moving back to bottom by 200-300psi(?) | 445 |
| 5 On Bottom-Dump Hi-Pass | Closed | Closed | Opened | Opened | | Once the pressure in the drillstring gets to the pre-determined pressure (set by driller), Hi-Pass opens(or is manually opened by driller). Driller drills ahead at faster P-Rates. | 450 |
| 6 Hi-Pass Empty Closes | Closed | Closed | Opened | Opened | | When PH is just 10psi or less above PB a short period of time, Hi-Pass Valve Shuts to remove Hi-Pass from Drillstring Plenum. | 455 |
| 7 Drilling Ahead | Closed | Closed | Opened | Opened | Closed | Drilling with Rig Air | 460 |

Optional Steps

| | | | | | | | |
|---|---|---|---|---|---|---|---|
| 6b Driller closes Hi-Pass Manually | Closed | Closed | Opened | Opened | | Driller wants to stop taking air from Hi-Pass. "Stop" button. | 465 |
| 5b Driller opens Hi-Pass Valve Manually | Closed | Closed | Opened | Opened | | Driller is ready for the Hi-Pass to dump (pressure set too high). "Dump" button. | 470 |

*FIG. 4*

600

675 680 685 690

| Drilling Step | Automation Valves 3A | 3D | 3C | 3B | Notes | |
|---|---|---|---|---|---|---|
| 1 Drilling Head | Closed | Closed | Opened | Closed | Drilling with Rig Air | 605 |
| 2 Making Connection Start Filling Hi-Pass | Open | | | | Dump Air Volume | 610 |
| | | Open | | | Dump Drillstring | 615 |
| | | | | | Isolate Drillstring | 620 |
| | Close | | Close | Open | Start Filling Hi-Pass-"Fill Button" | 625 |
| 3 Hi-Pass Full - By-Pass | Opened | Opened | Close | Close | When $P_H$ gets to 650psi or Set pressure, Hi-Pass Closes, 1/2 second delay?, Rig Valve opens | 630 |
| 4 Connection Made, Back to bottom | | | Opened | Closed | Bypassing air, open standpipe. | 635 |
| | | Close | | | Close Drillstring dump valve. | 640 |
| | Close | | | | Close By-Pass - Air starts filling drillstring. Start moving back to bottom by 200-300psi(?) | 645 |
| 5 On Bottom-Dump Hi-Pass | Closed | Closed | Opened | Open | Once the pressure in the drillstring gets to the pre-determined pressure (set by driller), Hi-Pass opens. Driller drills ahead at faster P-Rates. | 650 |
| 6 Hi-Pass Empty Closes | Closed | Closed | Opened | Close | When $P_H$ is just 10psi or less above $P_B$ For 1? Minute, Hi-Pass Valve Shuts to remove Hi-Pass from Drillstring Plenum. | 655 |
| 7 Drilling Ahead | Closed | Closed | Opened | Closed | Drilling with Rig Air | 660 |
| Optional Steps | | | | | | |
| 6b Driller closes Hi-Pass Manually | Closed | Closed | Opened | Close | Drilling wants to stop taking air from Hi-Pass. "Stop" button. | 665 |
| 5b Driller opens Hi-Pass Valve Manually | Closed | Closed | Opened | Open | Driller is ready for the Hi-Pass to dump (pressure set too high). "Dump" button. | 670 |

| | | |
|---|---|---|
| Smart Hi-Pass Valve | If Hi-Pass pressure $P_H$ is lower than Booster Pressure $P_B$, Hi-Pass valve will not open. Need to be able to over-ride this for first filling. Some Delays for opening & Closing need to be set - unknown. | 695 |

| Jargon | | Approximate |
|---|---|---|
| Fill Pressure | Maximum pressure for Hi-Pass | 650psi |
| Dump Pressure | Drillstring pressure Set by driller where Hi-Pass Opens | 300psi |
| Off Bottom Pressure | Pressure when air is just circulating | 200psi |
| PH | Hi-Pass Pressure | 300-650psi |
| PB | Booster Pressure | 350-1000psi |

*FIG. 6*

AIR STORAGE SYSTEM

BACKGROUND OF THE INVENTION

The present invention generally relates to the field of drilling for oil, gas and water. More particularly, the present invention relates to air drilling and an apparatus, system and process for air storage for speeding up and making the air drilling process more efficient.

Air drilling, which is also known as pneumatic percussion drilling is a technique in which gases, usually compressed air or nitrogen, are used in place of conventionally used liquids to cool the drill bit and lift the cuttings of a wellbore. It can be more efficient and inexpensive than conventional drilling. The first recorded use of air drilling was in the early 1860s. A piston-type compressed air mechanical drill bit bored an 8.5-mile-long Mont Cenis Tunnel in the Alps. Air drilling became a popular alternative to rotary drilling in the late 1940s and early 1950s. Because of limited air compression equipment to properly clean the annulus as the well was drilled, air-drilled holes were normally limited to shallow wells (<6000 ft.). But by the late 1970s, air-drilled holes became deeper when larger volume air compressors and high-pressure boosters were developed. The use of high-pressure air compression equipment rose after a downturn of the oil and gas industry in the 1980s because of the development of a high-energy air hammer and diamond-enhanced hammer bits. The hammers and bits greatly increased the rate of penetration and footage in certain air drilling areas as the Appalachian and Arkoma Basins, thus reducing drilling costs in these areas. These new developments also opened the door for deeper air drilling applications by decreasing both the number of bit trips and the need to downsize the hole's diameter from gauge wear. A drill string on a drilling rig is a column, or string, of drill pipe that transmits drilling fluid and torque to the drill bit. The term is loosely applied to the assembled collection of the drill pipe, drill collars, tools and drill bit. Tripping is the complete operation of removing the drill string from the wellbore and running it back in the hole. This operation is typically undertaken when the bit (which is the tool used to crush or cut rock during drilling) becomes dull or broken, and no longer drills the rock efficiently. A typical drilling operation of deep oil or gas wells may require numerous trips of the drill string to replace a dull rotary bit for one well.

Because air is the ideal low density drilling medium, air drilling itself provides many advantages. To achieve the best results and greatest economy, several factors must be considered for air drilling. The best conditions for air drilling involve hard, dry formations that produce relatively few formation liquids. Once the formation is completely dry, or the influx of liquids is small enough to be absorbed in the air stream, the drill cuttings return to the surface as dust. The process allows for the immediate and sustained evaluation of hydrocarbons. Other advantages of air drilling are low cost, increased rate of penetration, extended bit life, superior control in cavernous and lost circulation areas, and minimal damage to liquid-sensitive pay zones. The drill string always remains on the bottom when gas is encountered, which is a tremendous advantage in well control. If no gas is in the hole when a trip is made, no gas will be in the hole when the new bit is returned to the bottom. Sometimes holes filled with mud will allow gas to enter the well bore because of reduced hydrostatic pressure, creating well control issues. With air drilling, gas that has already been penetrated will enter the well bore on trips, but the amount of gas is a known quantity that can easily be jetted away from the rig and operating personnel.

In certain types of air drilling known as air rotary drilling, air alone lifts the cuttings from the borehole. A large compressor provides air that is piped to the swivel house connected to the top of the drill pipe. The air, forced down the drill pipe, escapes through small ports at the bottom of the drill bit, thereby lifting the cuttings and cooling the bit. The cuttings are blown out the top of the hole and collect at the surface around the borehole. Another type of air drilling is reverse air drilling. A tremie pipe is inserted inside the drill pip with a check valve on the bottom of the tremie. Once the formation has produced water, reverse air drilling can begin. As drill rods are added, length of tremie pipe are also added until the tremie is submerged. Air is introduced into the tremie which aerates the column of water within the drill rod. The now aerated column is less heavy than the fluid outside the drill pipe. Air-assisted lift is created up the drill pipe, drawing cuttings from the borehole through the bit, ejecting them at the exit hose attached to the top of the swivel and into the holding pond. Once a water bearing formation is reached, there is little chance of contaminants being introduced in to the borehole. Another type of air drilling uses a down hole air hammer for drilling effectively in hard formations. The downhole air hammer is an activated percussive drilling bit which operates in the manner of a jack hammer commonly seen in surface construction.

However, because air is compressible unlike fluids, air must be compressed to provide energy to drill, and because the process of adding another piece of pipe to the well hole (known as making a connections), air drilling loses pressure to the atmosphere, air drilling has issues because as one drills down and needs to add another piece of pipe to continue drilling, called making a connection, air must be bled off to make this new connection. Once the new connection is made, the air from the compressors is sent back down the drill pipes to start the process again. The driller must now wait for enough air pressure and volume to build up to work the air hammer and lift the drill cuttings out of the well bore. The time it takes for the air to build back up results in increases in the drilling cost because during the air pressure build up time, no drilling is occurring. During this wait time, there is not enough air in the well bore to operate drill motors, air hammers and directional tools because they won't operate without proper air pressure. So other problems can occur. During the air drilling process, drill cuttings are lifted up with air. While air pressure and volume is rebuilding to work the air hammer, no drill cuttings are lifted from the well bore. While waiting for the air pressure and volume to build up to work the air hammer, a mud ring can occur, causing the well bore to become packed off or stopped up. This results in hanging up the drill string and causing it to be stuck in the well bore resulting in a very expensive problem for drillers. The chances for the well bore getting stuck in the well hole increase greatly as time passes waiting for the air to build up after a pipe connection has been made. The deeper the well bore is in the well hole the longer it talks to build the air pressure and volume back up.

SUMMARY OF THE INVENTION

The present air storage system solves these problems when drilling down and adding other pieces of pipe to continue the drilling process: loss of all air volume and pressure in the well; drill cuttings not being lifted from the well bore; drill motors, air hammers and directional tools that can't operate without proper air pressure; and formation of a mud ring causing the well bore to become packed off or stopped up.

The present air storage system or machine, also called an air pack or a hi-pass, is used to divert high pressure air from the air compressors into the air pack/hi-pass for storage during the pipe connection process. This air would normally be diverted to the flowline and vented through the flare stack to the atmosphere. Such air diverted to the atmosphere is essentially wasted. In the present invention, such air can be stored in the air pack/hi-pass until the connection is made and the driller is ready to resume drilling. This high pressure large volume of stored air in the air pack/hi-pass helps the compressors quickly build up enough air to resume the drilling process thus reducing the amount of drill downtime during the process of making a new pipe connection. Reducing the drilling down time results in more drilling time. Reducing the drilling down time reduces the chances of a mud ring occurring or the drill bore getting stuck in the well hole by being packed off or stopped up since the time for air pressure and volume to build up to work the air hammer and other drilling tools is reduced. Less drilling downtime and more drilling up time saves drillers money.

In its operation, the air storage system (air pack or hi-pass) is charged with air from the storage system during the process of adding another piece of pipe to the well hole to continue drilling, known as making a connection. The stored compressed air is then used when re-establishing air pressure to the well. The air storage system compressed air that is normally bypassed to a flowline during the time when a connection is being made is stored in the system for use after a connection is made to allow air pressure and volume to build up more quickly to work the air hammer and other drilling tools.

Since the air storage system is a pressure vessel, it is equipped with redundant overpressure systems, such as pop-off valves and a pressure regulator valves. The pressure regulator is set to maintain constant pressure after reaching a pre-determined pressure setting and the pop-off valve provides redundant protection to ensure that the maximum allowable working pressure is not reached or exceeded in case of failure of the pressure regulating valve. A skid may contain the air storage system to keep it contained to prevent spills from any liquids while draining the system.

The air storage system may have three to five connections: a supply from the hi-pass tank itself, a discharge line to the drilling rig's standpipe manifold, one or two connections to the flow line for the pressure regulating line and one going to the air supply tank.

The present invention comprises an air storage system for maintaining the pressure of compressed air in a well during air drilling operations when drilling down in the well when connecting one or more pipes to an existing pipe in the well to continue the drilling process. In one embodiment, it comprises an air supply line with a first end connected to an air source and a second end connected to a drill rig line; an air storage tank removably connected to a second end of the air supply line; an air pressure discharge line with two ends removably connected to the air storage tank, a flowline to regulate excess pressure and the rig line; a first end of the rig line removably connected to a discharge line of a drilling rig; a first valve connected to the rig line to isolate the air storage tank from the rig discharge line; a second valve connected to the drill rig line to isolate the rig discharge line while the system is being pressurized. The system may also comprise a pressure regulating valve connected to one end of the air pressure discharge line that allows excess air pressure in the system to exit via the air pressure discharge line to the flowline. It may also comprise a pop-off valve connected to a second end of the air pressure discharge line for redundant pressure control allowing excess air pressure in the system that does not exit through the flowline to escape through the second end of the air pressure discharge line.

The present invention comprises a method of maintaining pressure of compressed air in a well during drilling operations in the well when connecting one or more additional pipes to an existing pipe in the well. In one embodiment, the method provides an air supply line with a first end connected to an air source and a second end connected to a drill rig line; an air storage tank removably connected to a second end of the air supply line; an air pressure discharge line with two ends removably connected to the air storage tank, a flowline to regulate excess pressure and the rig line; a first end of the rig line removably connected to a discharge line of a drilling rig; a first valve connected to the rig line to isolate the air storage tank from the rig discharge line; a second valve connected to the drill rig line to isolate the drill rig discharge line while the system is being pressurized; a pressure regulating valve connected to one end of the air pressure discharge line that allows excess air pressure in the system to exit via the air pressure discharge line to the flowline; and a pop-off valve connected to a second end of the air pressure discharge line for redundant pressure control allowing excess air pressure in the system that does not exit through the flowline to escape through the second end of the air pressure discharge line.

When an additional pipe is to be connected to the existing pipe in the well, the second valve connected to the rig line to isolate the air storage tank from the rig discharge line is closed. The first valve connected to the rig line to allow compressed air from the air supply source to be stored in the air storage tank is open. Compressed air in the air storage tank is stored. After the additional pipe is connected to the existing pipe in the well, the second valve is opened to allow the compressed air stored in the storage tank to flow into the well via the drill rig discharge line until the pressure in the drill rig reaches an optimal pressure for resuming drilling operations.

The method further comprises if the pressure regulating valve senses excess air pressure in the system, the pressure regulating valve will allow compressed air to exit the system via the flowline until the air pressure in the system reaches a safe level. If the air pressure in the system reaches an unsafe level, the pop-off valve is activated to allow compressed air to exit the system through the second end of the air pressure discharge line.

BRIEF DESCRIPTION OF THE DRAWINGS

These and other features, aspects and advantages of the system will become better understood with regards to the following description, appended claims and accompanying drawings wherein:

FIG. 4 illustrates an exemplary embodiment of the air storage system operation process for a two valve type system.

FIG. 6 illustrates an exemplary embodiment of the air storage system operation process for a four valve system.

DETAILED DESCRIPTION OF SYSTEM

Figure 1:
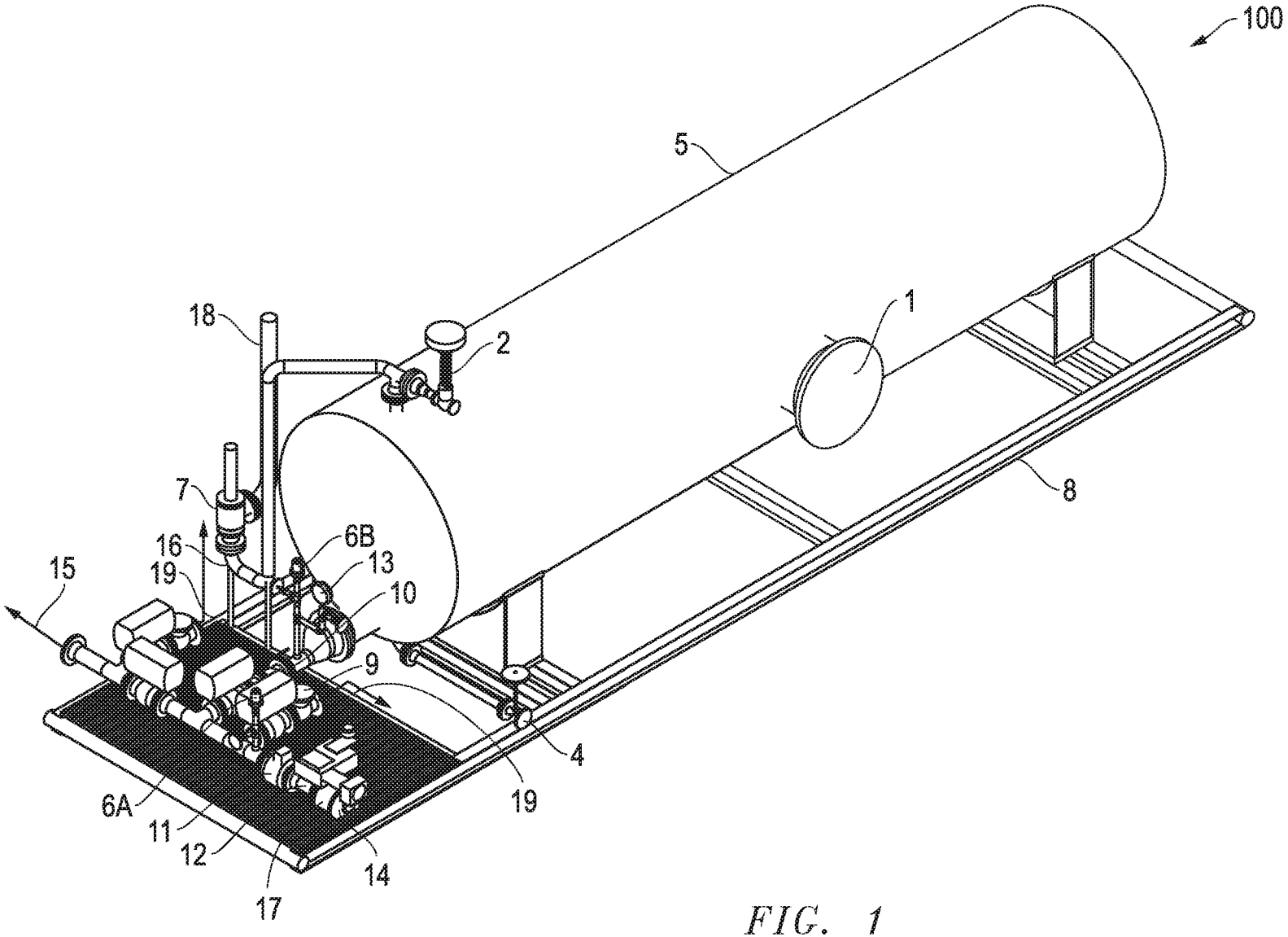
FIG. 1 illustrates an exemplary embodiment of the air storage system showing four valves.

FIG. 1 illustrates an exemplary embodiment of the air storage system. Turning now to FIG. 1, the air storage system 100 for maintaining the pressure of compressed air in a well during air drilling operations to continue the drilling process when drilling down in the well and connecting one or more pipes to an existing pipe in the well is shown. It is removably connected an equipment skid 8 and to a compressed air supply source and boosters 14 on a first end with an opposite (second) end connected to a drilling rig line 15. An air storage tank 5 is connected to a pressure regulator such as a kim-ray regulator 2 which may be positioned on the top of the tank, piped 16 to a pressure relief valve or pop off valve 7 and then to an exhaust tubing isolation valve 10 for safety. The air storage tank 5 may comprise one or more air storage tanks. Supply air from the air compressors and boosters 14 connect to the header manifold 17 (see FIG. 9 for more detail). A supply line to the drilling rig standpipe is attached to an opposite or second end 15 of the manifold 17. Connections to the flow line or bypass line are connected behind the check valve 9 and another line going to the same flow line or bypass line is connected to a first and a second drill string vent valve 9. A hose (not shown) may be connected to the drill string vent line 9 or to the compressor vent 3A to take excess air to a flow line 19.

A first pressure transducer 6A measures drilling rig pressure. A second pressure transducer 6B measures air storage tank 5 pressure. The air storage system 100 has a man way opening 1 to provide for cleanout of the air storage tank 5. The pressure regulator 2 is a pressure regulating valve. If the pressure in the system gets above a certain range, the pressure regulator 2 acts like a pop-off valve to release excess air to reduce pressure. The following valves are attached to the manifold 17: compressor vent valve 3A, high pass valve 3B, drill string valve 3C and drill string vent valve 3D. The hi-pass valve 3B may also be removably attached to a hose going to the flow line.

Pressure transducers 6A and 6B are used by the control box to open and close one or more pressure relieve valves 7. The drill string vent valve 3D and the compressor vent valve 3A both go to hoses (also known as flow lines but not shown) to vent excess air. There may also be hoses attached to the manifold 17 to connect to the drill rig 15 and compressors/boosters 14. Pressure relief valve 7 is attached to the air storage tank 5 so if pressure gets too high, air is exhausted to the atmosphere. The drain valve 4 allows excess water to be drained from the air package system 100.

The isolation valve 10 may be a manual valve that serves the same purpose as the hi-pass valve 3B. The compressor vent 3A and the drill string vent 3D will connect to a flow line (not shown) which vents the system to control pressure within the system. An optional pressure control valve 12 may be connected to the manifold 17 and allows the hi-pass air storage tank 5 to be filled to a higher pressure than the drill rig pressure.

The method of maintaining pressure of compressed air in a well during air well drilling operations when connecting one or more additional pipes to an existing pipe in the well comprises providing: an air supply line removably connected to a compressed air supply source and boosters 14 on a first end of the manifold 17 and on a second end of the manifold 17 to a rig drilling line 15, an air storage tank 5 removably connected to a pressure regulator 2 that may be positioned on the top of the air storage tank 5, piped 16 to a pressure relief valve or pop off valve 7 and then to an exhaust tubing isolation valve 10 for safety; supplying air from the air compressors and boosters 14 connected to a manifold 17 (see FIG. 9), connecting a supply line to the drilling rig standpipe which attached to a second end 15 of the manifold 17; connecting the flow line or bypass line behind the check valve 9 with another line going to the same flow line or bypass line connected to a first and a second drill string vent valve 9; connecting a hose (not shown) to the drill string vent line 9 to take excess air to the flow line opening 19.

The method of using the air package storage system also comprises providing: a first pressure transducer 6A for measuring drilling rig pressure; a second pressure transduce 6B measuring air storage tank 5 pressure a man way opening 1 to provide for cleanout of the air storage tank 5; a pressure regulator 2 for measuring pressure in the air storage tank 5. If the pressure in the system gets above a certain range, the pressure regulator 2 acts like a pop-off valve to release excess air and thereby reduce pressure. The following valves are attached to the manifold 17: compressor vent valve 3A, high pass valve 3B, drill string valve 3C and drill string vent valve 3D. The hi-pass valve 3B may also be removably attached to a hose going to the flow line opening 19. Pressure transducers 6A and 6B are used by the control box shown in FIGS. 7 and 8 to open and close pressure relieve valves 7.

In this method of using the air package storage system, the drill string vent valve 3D and the compressor vent valve 3A both go to hoses (not shown) to take excess air. There may also be hoses attached to the manifold 17 for drill rig 15 and compressors 14. Pressure relief valve 7 is attached to the air storage tank 5 so if pressure gets too high air is exhausted to the atmosphere. The drain valve 4 allows excess water to be drained from the air package system 100.

In this method of using the air package storage system, the isolation valve 10 is a manual valve that serves the same purpose as the hi-pass valve 3B. The compressor vent 3A and the drill string vent 3D will connect to a flow line (not shown) which vents the system to control pressure within the system. An optional pressure control valve 12 may be connected to the manifold and allows the hi-pass air storage tank 5 to be filled to a higher pressure than the drill rig pressure. The method may also provide using an air pressure discharge line 18 removably connected to the air storage tank 5.

During normal drilling operations, the compressor vent valve 3A, drill string vent valve 3D and hi-pass (air storage tank) valve 3B will be closed and the drill string valve 3C will be open allowing compressed air from the compressed air supply source 14 to flow to the rig 15 through the manifold 17. At this time, there will be no pressure or flow into the air storage tank 5. As long as this configuration of valve opening and closings is maintained, drilling operations can continue normally as if the air storage system 100 was not present.

During process of making a new connection to add to the drilling pipe in the well hole, the drilling rig will bypass the air storage system at the manifold 17 to the flowline 19 and bleed pressure of the drill string using the string vent 3D. At this time the hi-pass air package operator can open the compressor vent 3A and drill string vent valve 3D, close the drill string valve 3C and open the hi-pass valve 3B. The air storage tank 5 of the air storage system 100 will begin to charge with compressed air and build pressure.

While the air storage system is being charged, the pressure is closely monitored. Once pressure reaches a set pressure which may be about 650 psi, the hi-pass valve 3B and drill string valve 3C are closed. The compressor vent valve 3A is opened. Once the pipe connection is made, the compressor vent valve 3A and the drill string vent valve are closed, the hi-pass valve 3B is closed and the drill string valve 3C is opened. Air starts filling the drill string well and the compressed air starts moving through the well. Once the pressure in the drill string of the well gets to a predetermined pressure (either set by the driller or automatically set), the hi-pass valve 3B opens. When the pressure $P_H$ is about 10 psi or less above $P_B$ for a set period of time, the hi-pass valve 3B closes and removes the hi-pass storage tank 5 from the drill string plenum. Optional steps include a manual capability where the driller closes the hi-pass valve 3B manually. Another optional step is when the driller wants to use the compressed air stored in the air storage tank 5 and manually opens the hi-pass valve 3B.

After the connection to add to the drilling pipe in the well hole is finished and the drilling rig is ready to put air back down into the well hole and resume drilling, the manifold may be lined up and the air storage system will begin sending air down the drill string and into the well hole normally through the manifold 17 connected to the compressor 14.

Figure 2:
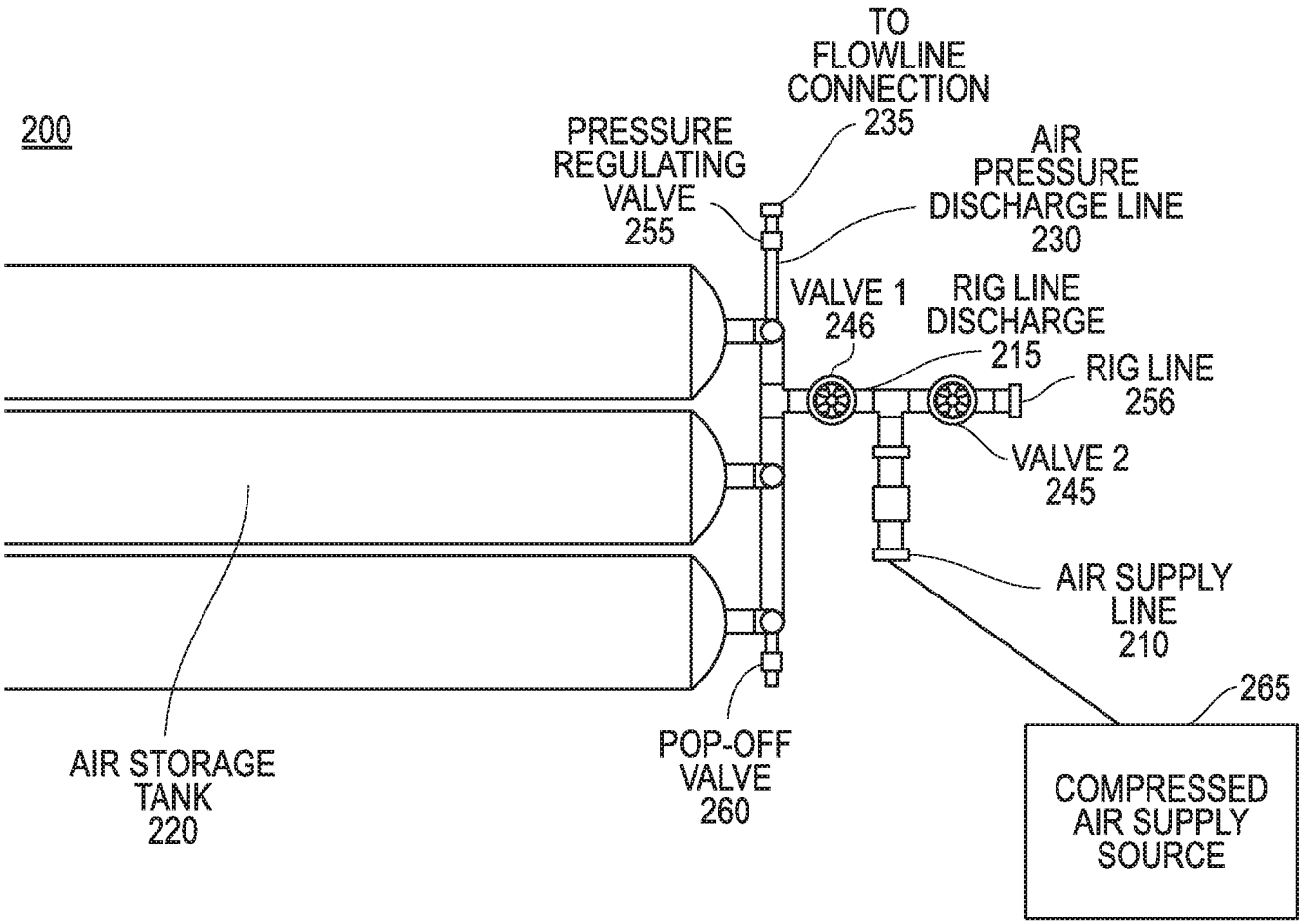
FIG. 2 illustrates an exemplary embodiment of the air storage system showing two valve types.

FIG. 2 illustrates an exemplary embodiment of the air storage system showing two valve types. Turning now to FIG. 2, the air storage system 200 for maintaining the pressure of compressed air in a well during air drilling operations when drilling down in the well when connecting one or more pipes to an existing pipe in the well to continue the drilling process is shown. It comprises an air supply line 210 removably connected on a first end to a compressed air supply source 265 and connected on a second end to a drilling rig discharge line 215. An air storage tank 220 is connected to the air supply line 210. The air storage tank may comprise one or more air storage devices. An air pressure discharge line 230 is removably connected to the air storage tank 220, an air pressure discharge line 230, and to a flowline connection 235 to regulate excess pressure and to the drill rig discharge line 215. A first valve 246 is connected to the drill rig discharge line 215 to isolate the air storage tank 20 from the drill rig discharge line 215 which is itself connected to a rig line 256. A second valve 245 is connected to the drill rig discharge line 215 to isolate the air storage system from the drill rig line 256. A pressure regulating valve 255 is connected to a first end end of the air pressure discharge line 230 that in operation allows excess air pressure in the system to exit via the air pressure discharge line 230 through the flow line connection 235. A pop-off type valve 260 is connected to a second end of the air pressure discharge line 230 allowing excess air pressure in the system that does not exit through the flowline connection 235 to escape through the air pressure discharge line 230. A motor connected to the compressed air supply source 265 powers the air storage system 200. The air storage system 200 may be mounted on a skid and may be fully contained to prevent spills while draining the system from any liquids.

The method of maintaining pressure of compressed air in all types of well drilling operations using air a well during drilling operations in the well when connecting one or more additional pipes to an existing pipe in the well comprises providing: an air supply line 210 removably connected on a first end to a compressed air supply source 265 and on a second end to a rig discharge line 215, an air storage tank 220 removably connected to the air pressure discharge line 230, an air pressure discharge line 230 removably connected to the air storage tank 220, a flowline connection 235 to regulate excess pressure and a line to the drilling rig 250, a first valve 246 connected to the drilling rig discharge line 215 to isolate the air storage tank 220 from the rig discharge line 215, a second valve 245 is connected to the rig discharge line 215 to isolate the air storage system from the rig 250, a pressure regulating valve 255 connected on a first end to one end of the air pressure discharge line 230 that in operation allows excess air pressure in the system as measured by a pressure measuring device 80 to exit via the air pressure discharge line 230 through the flow line connection 235 and a second end to a pop-off type valve 260 connected to a second end of the air pressure discharge line 230 that allows excess air pressure in the system that does not exit through the flowline connection 235 to escape through the air pressure discharge line 230. When an additional pipe is to be connected to an existing pipe in the well, the second valve 245 connected to the drilling rig discharge line 215 is closed. The first valve 246 connected to the rig discharge line 215 is opened to allow compressed air from an air supply source 265 to be stored in the air storage tank 20. After the additional pipe is connected to the existing pipe in the well, the second valve 245 is opened to allow the compressed air stored in the storage tank 220 to flow into the well via the rig discharge line 215 until the pressure in the rig 250 reaches an optimal pressure for resuming drilling operations.

During normal drilling operations valve 246 will be closed and valve 245 will open allowing compressed air from the compressed air supply source 265 to flow to the rigs 250 standpipe manifold. At this time there will be no pressure or flow into the air storage tank 220. As long as valve 246 is closed and valve 245 is open, drilling operations can continue normally as if the air storage system 200 was not present.

During process of making a new connection to add to the drilling pipe in the well hole, the rig will bypass the air storage system at the standpipe manifold to the flowline and bled pressure of the drill string using the string bled down line. At this time, the hi-pass air package operator can open valve 246 and close valve 245. The air storage tanks 220 of the air storage system 200 will begin to charge with compressed air and build pressure.

While the air storage system is being charged, the pressure is closely monitored. Once pressure has reached the last operating pressure, valve 245 may be opened and valve 246 may be closed. The pressure regulating valve 255 and pop-off valve 260 are designed to not allow overpressure of the system. The pressure regulating valve 255 will begin to open at pre-determined pressure and if this valve or its line is blocked the pop-off valve 260 will function to prevent overpressure of the system.

After the connection to add to the drilling pipe in the well hole is finished and the drilling rig is ready to put air back down into the well hole and resume drilling, the standpipe manifold may be lined up and the air storage system will begin sending air down the drill string and into the well hole normally. At this time, valve 246 can be opened allowing the stored air in the air storage system to begin discharging into the well hole. Once pressure has stabilized valve 246 can be closed again and the process will be repeated for the next new connection to add to the drilling pipe in the well hole. The valves 246, 245 may be set to open slowly and may be adjusted. The air storage system 200 has a drain line for each storage bottle that may be routinely drained during operation and completely drained while not in operation.

Figure 3:
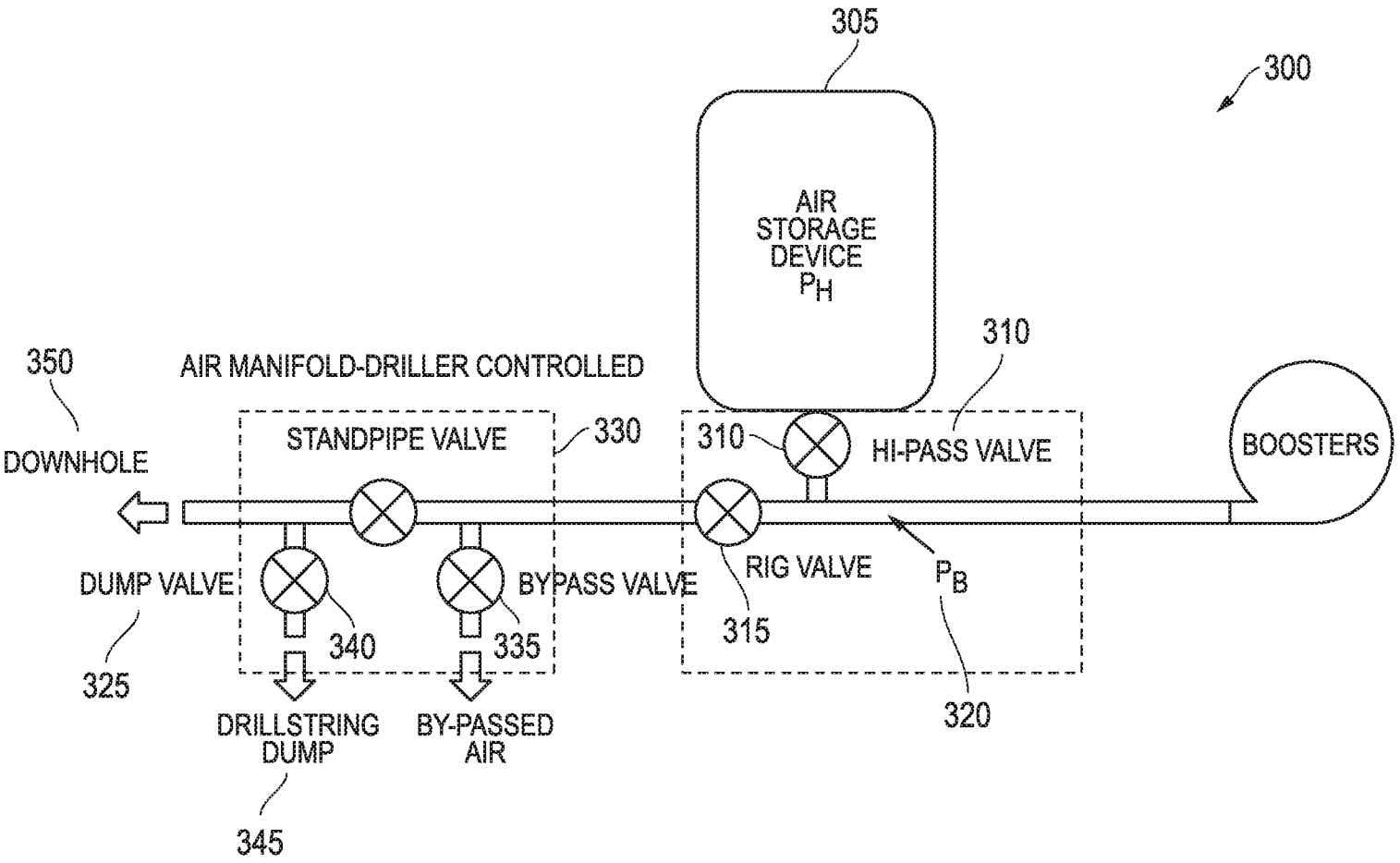
FIG. 3 illustrates an exemplary embodiment of the air storage system with two valve types.

FIG. 3 illustrates another embodiment of the air storage system. FIG. 4 illustrates the air storage system operation process for a two valve-type system which in this embodiment has five sub-valves. The two main valve types are (1) air manifold valves and (2) automation valves. Turning now to FIGS. 3 and 4, the air storage system 300, 400 for maintaining the pressure of compressed air in a well during air drilling operations when drilling down in the well when connecting one or more pipes to an existing pipe in the well to continue the drilling process and the process of operating the air storage system are shown. The air manifold valves are comprised of the bypass 335, 475, dump 325, 480 and standpipe valves 330, 485. The automation valves are comprised of the rig 315, 490 and hi-pass valves 310, 495. During the normal drilling process 405, the rig uses its own air to drill and does not need to rely on the air storage system. When an additional pipe connection is to be made, 410-425, air volume is dumped using the dump valve 325, 480 and the drill string dump 345. The drill string dump is isolated 425, 345 and the air storage tank (device) 305 starts to fill 425,305. When the pressure in the air storage tank 305 gets to a certain level, for example such as 650 psi, the hi-pass valve 310, 430 closes and the rig valve 315, 430 opens.

Once the pipe connection is made 435-445, the standpipe valve 330, 435 is opened bypassing air. The drill string dump valve 325, 345, 440 is closed. The bypass valve 335 is closed and air starts filling the drill string downhole 450 and pressurized air starts moving back downhole to the bottom of the well 445, 350.

Once pressure in the drill string gets to a predetermined pressure which is set by the driller, the hi-pass valve 310 opens or is manually opened by the driller and the driller can now drill at faster pressure rates 450. When the high pressure $P_H$ is close to the lower $P_b$, the hi-pass valve 310 closes to remove the air storage system 305 from the drill string 455. Optional steps for step 455 include the driller closes the hi-pass valve 310 manually, that results in no air being taken from the air storage device 305, 465. Another optional step for steps 455, 465 include that the driller opens the hi-pass valve 310 manually and the driller is ready for the air storage device to dump air because the pressure is set too high 470.

Once the connection has been made drilling continues with the drilling rig air 460 without using the air storage system.

Figure 5:
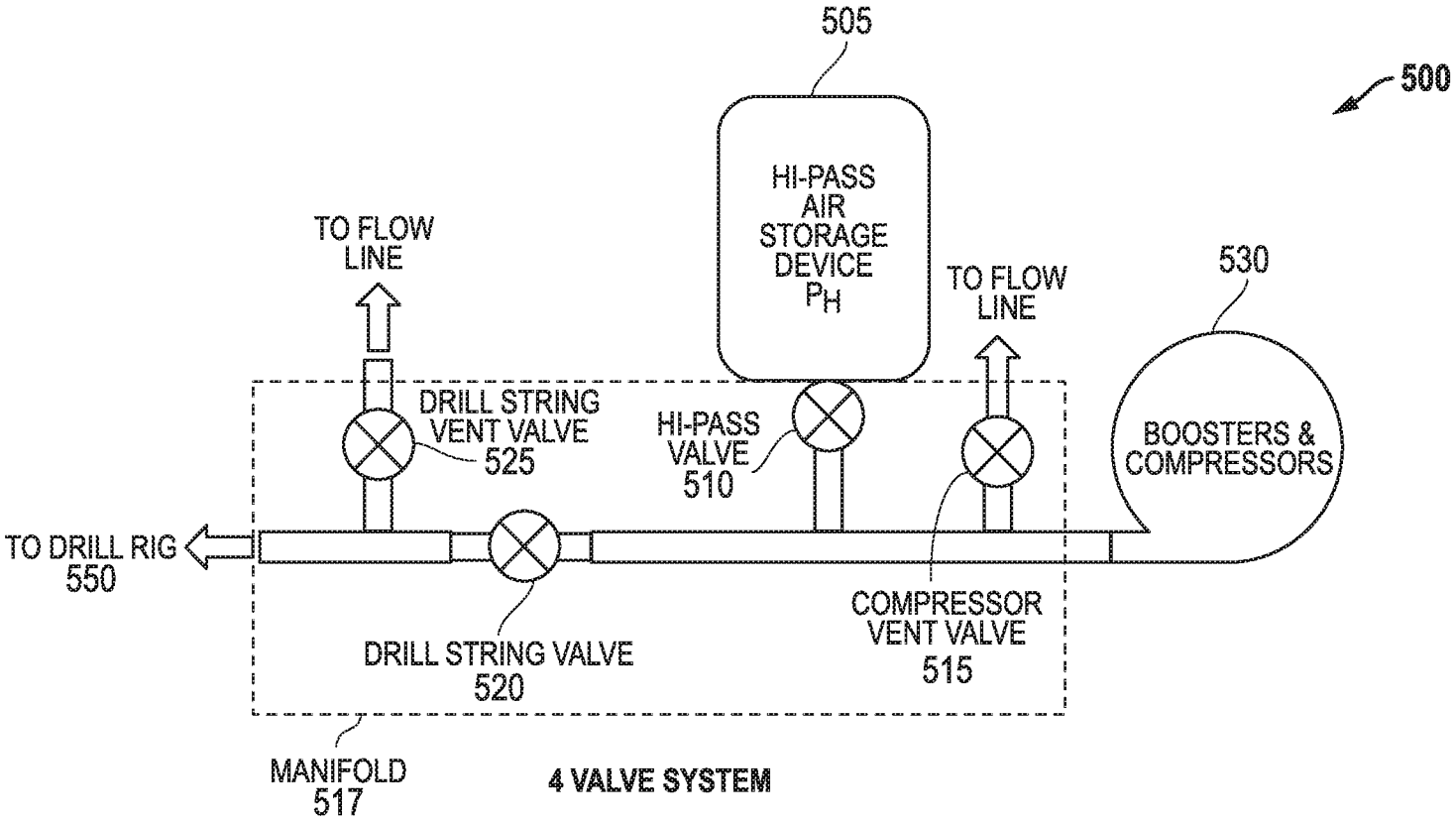
FIG. 5 illustrates an exemplary embodiment of the air storage system with four valves.

FIG. 5 illustrates another embodiment of the air storage system. FIG. 6 illustrates the air storage system operation process for a four valve-type system. Turning now to FIGS. 5 and 6, the air storage system 500, 600 for maintaining the pressure of compressed air in a well during air drilling operations when drilling down in the well when connecting one or more pipes to an existing pipe in the well to continue the drilling process and the process of operating an air storage system 500, 600 are shown. The manifold 517 comprises a four valve system that runs from the boosters and compressors 530 through to the drill rig 550. The automation valves are comprised of the compressor vent 515, drill string vent 525, drill string valve 520 and hi-pass 510 valves. During the normal drilling process 605, the drilling rig uses its own air to drill and does not need to rely on the air storage system. When an additional pipe connection is to be made, 610-625, air volume is dumped using the dump valve 610 and the drill string dump 615. The drill string is isolated 620 and the air storage tank 505 starts to fill 625. When the pressure in the hi-pass/air storage device 505 gets to a certain level, for example such as about 650 psi, the hi-pass valve 510, 630 closes and the compressor vent valve 515, 630, 675, and drill string vent valve 525, 625, 680 opens.

Once the pipe connection is made 635-645, the compressor vent valve 515, 645, 675 is closed and the drill string vent valve 525, 640, 680 is closed. The drill string valve 520, 650, 685 is opened. Air starts filling the drill string downhole 650 and pressurized air starts moving back to the bottom of the well 650.

Once pressure in the drill string gets to a predetermined pressure which may be automate or set by the driller, the hi-pass valve 510, 690 opens or is manually opened by the driller and the driller can now drill at faster pressure rates 650. When the high pressure $P_H$ is close to the lower $P_b$, the hi-pass valve 510 closes to remove the hi-pass/air storage tank 505 from the drill string 655. Optional steps for step 655 include the driller closes the hi-pass valve 510 manually, that results in no air being taken from the hi-pass/air storage tank 505, 665. Another optional step for steps 655 and 665 includes that the driller opens the hi-pass valve 510 manually and the driller is ready for the air storage device to dump air because the pressure is set too high 670.

Once the connection has been made drilling continues with the rig air 660 without using the air storage system.

If the pressure $P_H$ in the hi-pass/air storage system (hi-pass pressure) is lower than Booster Pressure $P_B$, the hi-pass valve 510 will not open 695. This may be overridden for the purpose of a first filling. The maximum pressure for the hi-pass/air storage system, also known as the fill pressure, is at or about 650 psi. The drill string pressure, also known as the dump pressure, may be automatically set or may be set by the driller where the hi-pass opens may be set at or about 300 psi. The hi-pass pressure $P_H$ may be at or about 300 to 650 psi. The Booster Pressure $P_B$ may be at or about 350-1000 psi. The pressure when the air is just circulating with the hi-pass/air storage system, known as the off bottom pressure, may be at or about 200 psi.

Figure 7:
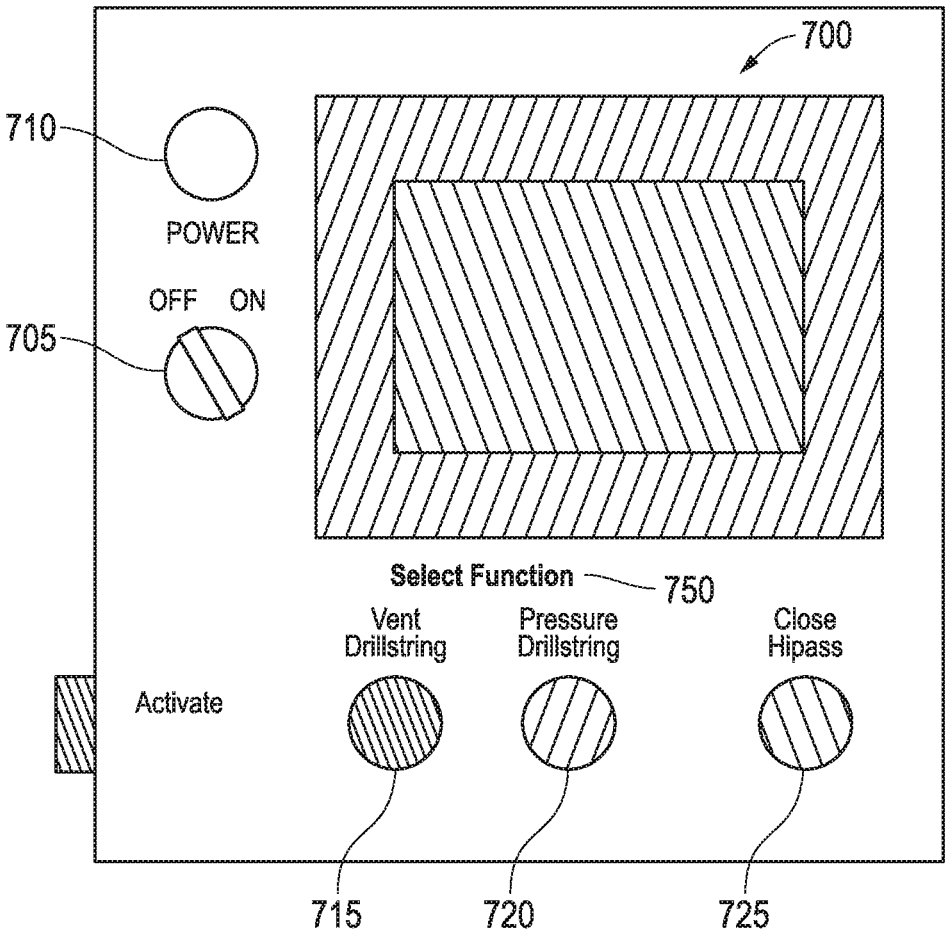
FIG. 7 illustrates an exemplary embodiment of an air package storage system operator control panel.
Figure 8:
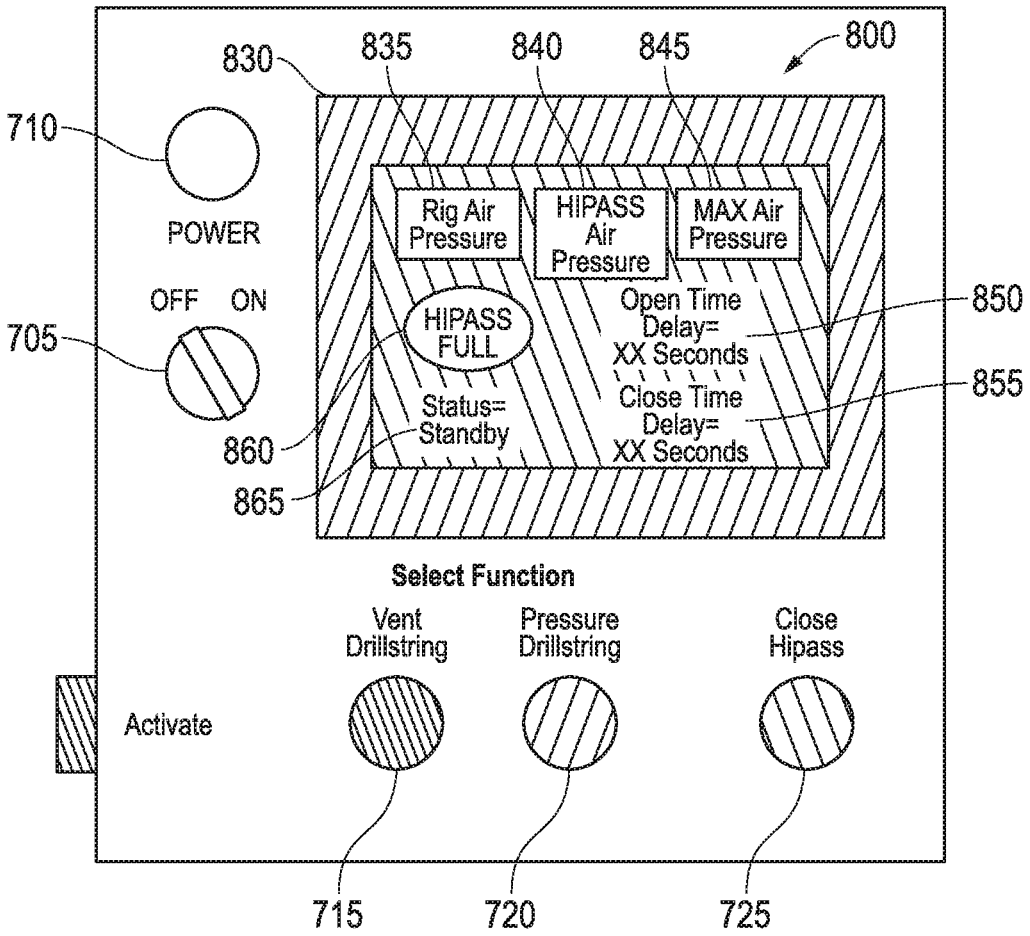
FIG. 8 illustrates an exemplary embodiment of an air package storage system operator control panel.

Turning now to FIGS. 7 and 8, an air package storage system operator control panel 700, 800 is shown. The control panel comprises a power button 705 and a power indicator 710. Buttons allow selection of the function to be performed: vent drill string 715, pressure drill string 720 and close hi-pass valve 725. A screen display 830 included the ability to display rig air pressure 835, hi-pass storage tank air pressure 840, maximum air pressure 845, hi-pass storage tank full indicator 860. The display also allows for an open time delay setting 850 and a close time delay setting 855 to be displayed. The close hi-pass function 725 immediately closes the hi-pass valve without pushing activate, regardless of other conditions. The select function 750 comprises the vent drill string 715 and pressure drill string 720 functions. The vent rill string 715 function comprises opening drill string vent valve and compressor vent valve, closing the drill string valve, opening the hi-pass valve and then closing the compressor vent valve to fill the hi-pass air storage tank. When it is filled, the hi-pass valve is closed 725 and the compressor vent valve is opened. The pressure drill string function 720 comprises opening the drill string valve, closing the compressor vent valve and the drill string vent valve. After the preset open time delay 850, the hi-pass valve is opened. After the hi-pass air storage tank and rig pressure equalize, the close time delay timer starts. After the close time delay ends, the hi-pass valve is closed.

Figure 9:
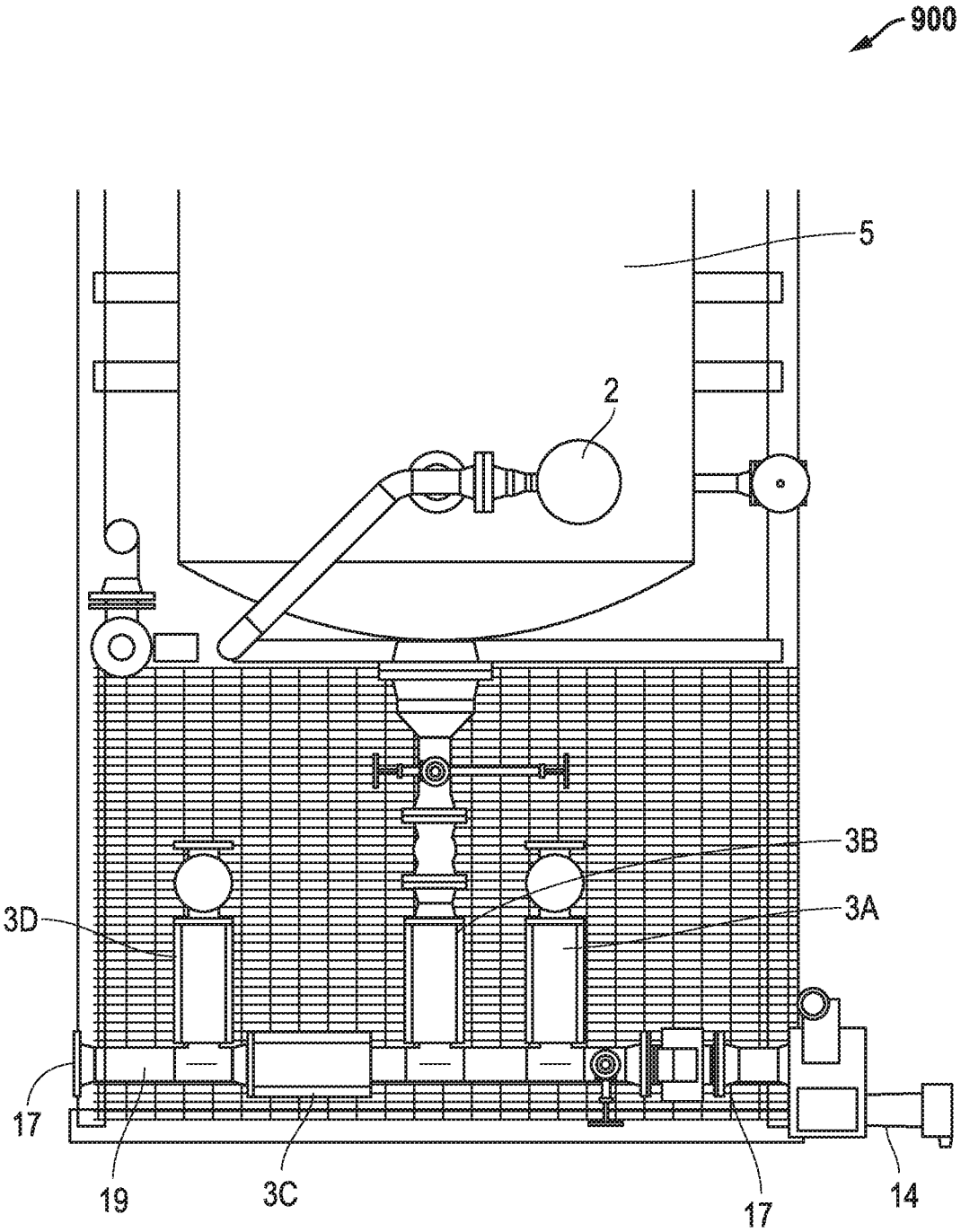
FIG. 9 illustrates a perspective view of a portion of an exemplary embodiment air package storage system.

Turning now to FIG. 9, a top down view of the hi-pass air storage tank system is shown 900. The manifold 17 includes a flow line 19. The flow line 19 is connected to a compressed air supply source and boosters 14 with another end connected to a drilling rig discharge line 15. An air storage tank 5 is connected to a pressure regulator 2 on the top of the air storage tank 5.

Although the system has been described in detail with reference to certain preferred embodiments, it should be apparent that modifications and adaptations to those embodiments might occur to persons skilled in the art without departing from the spirit and scope of the system.

The invention claimed is:

1. A method of maintaining pressure of compressed air downhole in a well during air drilling operations in the well when connecting one or more additional pipes to an existing drill pipe in the well comprising:

a. providing an air supply line with a first end removably connected to an air source and a second end removably connected to a drilling rig line;

b. providing an air storage tank for storing high pressure air prior to inserting the high pressure air into the well during drilling operations, the air storage tank is removably connected to the drilling rig line;

c. providing an air pressure discharge line removably connected to the air storage tank, having a flowline connection to regulate excess pressure in the drilling rig line;

d. providing a first valve connected to the drilling rig line to isolate the air storage tank from the drilling rig line;

e. providing a second valve connected to the drilling rig line to isolate the rig discharge line while the system is being pressurized;

f. providing a pressure regulating valve connected to one end of the air pressure discharge line, the pressure regulating valve allowing excess air pressure in the system to exit via the air pressure discharge line through the flowline connection; and g. providing a pop-off valve connected to a second end of the air pressure discharge line for redundant pressure control allowing excess air pressure in the system that does not exit through the flowline to escape through the second end of the air pressure discharge line;

h. when the additional pipe is to be connected to the existing pipe in the well, closing the second valve connected to the rig discharge line to isolate the air storage tank from the rig discharge line;

i. opening the first valve connected to the rig discharge line to allow compressed air from the air supply source to be stored in the air storage tank;

j. storing the compressed air in the air storage tank;

k. connecting the additional pipe to the existing pipe in the well;

l. after the additional pipe is connected to the existing pipe in the well, opening the second valve to allow the compressed air stored in the storage tank to flow into the well via the drilling rig line until the pressure in the rig reaches an optimal predetermined pressure for resuming drilling operations; and m. once the pressure in the rig reaches the optimal predetermined pressure, closing the second valve and continuing drilling without using the compressed air from the storage tank.

2. The method of claim 1 further comprising if the pressure regulating valve senses excess air pressure in the system, the pressure regulating valve will allow the compressed air to exit the system via the flowline until the air pressure in the system reaches a safe level.

3. The method of claim 2 further comprising if the air pressure in the system reaches an unsafe level, activating the pop-off valve to allow the compressed air to exit the system through the second end of the air pressure discharge line.

4. An air storage system for maintaining pressure of compressed air downhole in a well during air drilling operations in the well when connecting one or more pipes to an existing pipe in the well comprising:

a. an air supply line with a first end connected to an air source and a second end connected to a rig line;

b. an air storage tank removably connected to the air supply line;

c. an air pressure discharge line removably connected to the air storage tank, a flowline to regulate excess pressure in the rig line;

d. a first end of the rig line removably connected to a discharge line of a drilling rig;

e. a first valve connected to the rig line to isolate the air storage tank from the rig discharge line; and f. a second valve connected to the rig line to isolate the rig discharge line while the system is being pressurized;

g. a third valve for controlling the venting of excess high pressure air from the compressed air source; and h. a fourth valve connected to the manifold for controlling compressed air into and out of the rig line.

5. An air storage system according to claim 4 further comprising:

a. a pressure regulating valve connected to one end of the air pressure discharge line that allows excess air pressure in the system to exit via the air pressure discharge line to the flowline; and b. a pop-off valve connected to a second end of the air pressure discharge line for redundant pressure control allowing excess air pressure in the system that does not exit through the flowline to escape through the second end of the air pressure discharge line.

6. A manifold for removably connecting to a drill rig for air drilling of a well and for removably connecting to a compressed air source comprising:

a. a first valve for controlling a flow of high pressure air from the air source to the drill rig;

b. a second valve for controlling the venting of excess high pressure air from the drill rig; and c. a third valve for controlling the venting of excess high pressure air from the compressed air source;

wherein the first, second and third valves manage downhole air pressure in the drill rig by maintaining the flow of high pressure air from the compressed air source to the drill rig during a drilling process of connecting a pipe piece to the existing pipe in the well during the air drilling of the well.

7. The manifold of claim 6 further comprising for removably connecting to an air storage device further comprising a fourth valve for controlling the flow of high pressure air into and out of the air storage device.

8. An air storage system for maintaining pressure of compressed air in a well during air drilling operations in the well when connecting one or more pipes to an existing pipe in the well comprising:

a. a manifold with a first end removably connected to a compressed air source and a second end removably connected to a drilling rig line;

b. an air storage tank removably connected to the manifold;

c. a first valve connected to the manifold for controlling compressed air into and out of the air storage tank;

d. a second valve connected to the manifold for controlling the venting of air to atmosphere if excess pressure occurs in the air storage tank;

e. a third valve connected to the manifold for controlling the venting of excess drill string pressure in the drill rig; and f. a fourth valve connected to the manifold for controlling compressed air into and out of the drill rig.

9. The air storage system of claim 8 further comprising a. a pressure regulator attached to the air storage tank to measure pressure;

b. a pop-off valve connected to an air discharge line, which is removably connected to the air storage tank to allow air to be exhausted to atmosphere if the pressure regulator determines pressure has reached a threshold;

c. a first pressure transducer to measure drilling rig pressure; and d. a second pressure transducer to measure air storage tank pressure.

10. A method of maintaining pressure of compressed air in a well during drilling operations in the well when connecting one or more additional pipes to an existing pipe in the well comprising:

a. filling an air storage tank with compressed air by:

i. opening a first valve (hi-pass valve) connected to a manifold for allowing compressed air into the air storage tank;

ii. closing a second valve (drill string vent valve) connected to the manifold that prevents venting of air to atmosphere if excess pressure occurs in the air storage tank;

iii. filling the air storage tank with compressed air from a compressed air source removably connected to the manifold;

iv. when the pressure in the air storage tank reaches a predetermined level, closing the first valve to stop compressed air from filling the air storage tank and keeping the compressed air from exiting the air storage tank;

b. isolating a drill rig while a pipe connection in the well is being made by:

i. opening a third valve (compressor vent valve) connected to the manifold for allowing the venting of excess drill string pressure in the drill rig;

ii. closing a fourth valve (drill string valve) connected to the manifold for controlling compressed air into and out of the drill rig;

c. when the pipe connection is completed:

i. closing the first, second and third valves and opening the fourth valve;

ii. once the pressure in the drill rig reaches a predetermined pressure, opening the first valve and fourth valve to allow pressurized air from the air storage tank to flow into drill rig; and d. when the air storage tank is empty:

i. closing the first, second and third valves.

11. The method of claim 10 further comprising allowing the driller to manually close the first valve (hi-pass) to stop taking air from the air storage tank.

12. The method of claim 10 further comprising allowing the driller to open the first valve (hi-pass) manually to start taking air from the air storage tank.

13. An apparatus for maintaining high pressure of compressed air in a well during drilling operations in the well when connecting one or more additional pipes to an existing pipe in the well comprising:

a. an air storage tank capable of storing high pressure compressed air;

b. a first valve (hi-pass valve) having an open and closed position connected to a manifold for allowing high pressure compressed air into the air storage tank when the first valve is in an open position;

c. a second valve (drill string vent valve) having an open and closed position connected to the manifold, the second valve with in the closed position prevents venting of air to atmosphere if excess pressure occurs in the air storage tank;

d. a compressed air source removably connected to the manifold to fill the air storage tank;

e. wherein when the first valve is in the closed position, compressed air is stopped from filling the air storage tank and the compressed air is kept in the air storage tank when the pressure in the air storage tank reaches a predetermined level;

f. a third valve (compressor vent valve) having an open and a closed position connected to the manifold and when the third valve is in an open position and a pipe connection in the well is being made, excess drill string pressure in the drill rig line is vented; and g. a fourth valve (drill string valve) with an open and closed position connected to the manifold and when the fourth valve is in the closed position compressed air is controlled into the rig and when the fourth valve is in the open position compressed air is controlled out of the drill rig when a pipe connection is being made.

* * * * *